US006396032B1

(12) United States Patent
Denny et al.

(10) Patent No.: US 6,396,032 B1
(45) Date of Patent: May 28, 2002

(54) OVEN TEMPERATURE CONTROL CIRCUIT

(75) Inventors: Michael S. Denny, Springfield; Andrew Chang, Upper Darby; Mark L. Novack, Cheltenham, all of PA (US)

(73) Assignee: Athena Controls, Inc., Plymouth Meeting, PA (US)

( * ) Notice: Subject to any disclaimer, the term of this patent is extended or adjusted under 35 U.S.C. 154(b) by 0 days.

(21) Appl. No.: 09/791,271

(22) Filed: Feb. 23, 2001

Related U.S. Application Data

(60) Provisional application No. 60/185,651, filed on Feb. 29, 2000.

(51) Int. Cl.[7] ..... H05B 1/02

(52) U.S. Cl. ..... 219/501; 219/492; 219/506; 219/414

(58) Field of Search ..... 219/501, 506, 219/411–413, 494, 492; 307/117; 315/39.51

(56) References Cited

U.S. PATENT DOCUMENTS 4,517,430 A * 5/1985 Slottag ..... 219/10.55 B
4,879,878 A * 11/1989 Polkinghorne ..... 62/187
5,604,476 A * 2/1997 Schmidt et al. ..... 337/298
6,229,320 B1 * 5/2001 Haseyama et al. ..... 324/754

* cited by examiner

*Primary Examiner*—Mark Paschall
(74) *Attorney, Agent, or Firm*—Philip O. Post

(57) ABSTRACT

An oven temperature control circuit utilizes one or more light emitting diodes to establish a clamping voltage that limits the voltage at the input of a circuit component, such as an analog-to-digital converter, when a sensor, such as a thermistor, is connected to the input of the circuit component and the sensor is subjected to an EMI pulse. A method is provided for continued execution of a heating process after an unavoidable and unintentional interruption.

14 Claims, 4 Drawing Sheets

OVEN TEMPERATURE CONTROL CIRCUIT

CROSS-REFERENCE TO RELATED APPLICATIONS

This application claims the benefit of U.S. Provisional Application No. 60/185,651 filed Feb. 29, 2000.

BACKGROUND OF THE INVENTION

1. Field of the Invention

The present invention relates to temperature control circuits that use a processor to execute a heating program for heating a product in a heating chamber wherein the processor is subject to unintentional reset during execution of the heating program from electromagnetic interference.

2. Description of Related Art

A heating chamber, such as an oven, that is heated by a gas fired fuel source requires a means of initially igniting the gas. Ignition of the gas can be accomplished with an electric spark igniter. The igniter generates an electric spark across a gap in the presence of gas to ignite the gas. A temperature control circuit is used to establish a heating or cooking program for the heating chamber. The heating process is executed with a processor having appropriate input and output interfaces. The generated electric spark can radiate an electromagnetic field that will interfere with electric circuitry in its vicinity. Such interference is generally called electromagnetic interference (EMI). FIG. 1 diagrammatically illustrates a typical heating chamber 10 that uses a thermistor 6 as a temperature sensing element in the chamber and an electric spark igniter 5 to ignite gas supplied from an inlet 7 connected to a gas supply. Spark igniter controller 9 controls a gas control valve 11 that opens to release gas to outlet 13 when the igniter controller generates a high voltage across the spark gap of igniter 5. The resulting electric spark across the gap ignites the released gas. Temperature control circuit 15, powered from a suitable power supply 17, transmits a signal to the spark igniter controller that initiates the gas ignition process. Temperature control circuit 15 may also serve the function of a heating program controller that controls the temperature in the chamber for pre-determined time periods during the execution of the heating program. For example, a particular product may require that the chamber have a set temperature of 400° F. for 20 minutes, and then a set temperature of 250° F. for 40 minutes to achieve optimum heating of the product. As illustrated in FIG. 1, the temperature control circuit can also power and control one or more fan blower motors 19 for circulated convection heating in the heating chamber 10. The fan blowers may be operated in a pulse mode that turns the fan on and off for pre-determined (pulse) time periods. FIG. 2 illustrates a prior art temperature control circuit 25 that is used in a gas oven with an electric spark igniter. The typical temperature sensor, thermistor 6, exhibits a decreasing resistance as the temperature rises in heating chamber 10. A voltage divider is formed by supplying current from a source voltage reference VREF through resistor R7 in series with the thermistor. Capacitor C6, and resistors R2 and R3 form an R-C circuit that conditions the analog voltage input signal to the analog-to-digital (A/D) converter 20. The analog voltage input signal will change as the temperature in the chamber changes. Converter 20 outputs to processor 22 a digital signal on line 21 that represents the temperature in the chamber. Although a single line is shown, the digital signal may be transmitted on serial or parallel lines. Processor 22 uses the digital signal during execution of a heating program. Processor monitor 24 issues a reset signal to processor 22 on line 27 if a strobe input signal is not received from processor 22 on line 23 before a pre-determined watchdog time-out period has elapsed.

During execution of a heating program, the igniter 5 may re-ignite the gas a number of times following closure of control valve 11 after a set temperature has been reached in the chamber. During ignition, the electric spark generated across the gap of the igniter creates a broadband electromagnetic radiated pulse that is received by the thermistor 6 and propagated in the temperature control circuit. The associated electrical energy pulses in the conductors from the spark igniter controller to the igniter, and the circuitry of the spark igniter controller can also contribute to radiated EMI that is picked up by the temperature sensor. Unless adequate filtering is provided, components of the pulse will be injected into the input of the A/D converter and coupled into the power and ground voltages of all circuitry. The radiated EMI can also generate spurious signals on line 27 that can unintentionally reset the processor. Consequently, the temperature control circuit in FIG. 2 is susceptible to malfunction when the igniter generates a spark due to EMI.

An approach to solving to this problem is to use a voltage clamping circuit across the incoming lines from the thermistor to the temperature control circuit. However, a conventional clamping circuit, such as a zener diode or back-to-back diodes, still results in significant leakage at all voltages particularly when the thermistor has a large resistance range, such as 0 to 100 kilo-ohms (kohms). The leakage results in a non-linear error when reading the voltage, which is a function of temperature, across the thermistor. Because the error is non-linear and varies from sample to sample, it cannot be calibrated out.

Therefore, there exists the need for a temperature control circuit that will minimize the EMI effect on the circuit when it is used with a gas-fired heating chamber employing an electric spark igniter.

Total elimination of an unintentional processor reset in a temperature controller cannot be achieved. In addition to other sources of EMI, a temporary power failure during execution of a heating program will cause a processor to unintentionally reset. Time is lost in reinitiating a heating program after a processor reset. The problem can be solved by using an energy storage device such as a battery to retain power to components associated with storing and executing the cooking program. However, an energy storage system introduces a significant cost penalty and requires periodic replacement of the energy storage device.

It is another object of the invention to provide an efficient method of storing incremental cooking parameters during execution of a heating process so that if an unintentional reset occurs during the execution of a heating process the last set of valid cooking parameters can be recovered to continue operation of the process from the point before the reset.

BRIEF SUMMARY OF THE INVENTION

In one aspect, the invention is a temperature control circuit for use with a heating chamber having a temperature sensor. The circuit includes a first common mode choke with the temperature sensor connected across the line terminals of the first common mode choke. The analog input of an analog-to-digital converter is connected across the line terminals of a second common mode choke. An R-C circuit may be provided between the analog input of the converter and the line terminals of the second common mode choke. The first terminals of a pair of output terminals for the first and second common mode chokes are connected together at a positive polarity line, and the second terminals of the pair of output terminals for the first and second common mode chokes are connected together at a negative polarity line. A reference voltage is suitably connected to the positive polarity line. One or more light emitting diodes (LEDs) are connected together in series, with their anodes oriented to the positive polarity line, between the positive and negative polarity lines to provide a suitable clamping voltage that is greater than the reference voltage but less than the maximum voltage for the analog input to the analog-to-digital converter. A diode or LED is connected anti-parallel across the series connected LEDs. Additional capacitive filtering can be provided between the positive and negative polarity lines, and between each line and ground. Additional capacitive filtering can also be provided between the analog input to the converter and ground.

In another aspect, the invention is a method of recovering from an unintentional processor reset during the execution of a heating process to heat a product in a heating chamber. Valid heating state parameters are incrementally stored at fixed time intervals in a nonvolatile memory device during execution of the heating process. After the heating process is interrupted by an unintentional reset, the incrementally stored valid heating state parameters that were stored at the last fixed time interval prior to the interruption are read from the nonvolatile memory device, and the heating process resumes at a point determined from the last read incrementally stored valid heating state parameters. Prior to resuming the heating process, the current temperature of the heating chamber can be compared with the temperature of the heating chamber from the last stored valid heating state parameters. If the difference between the current temperature of the heating chamber and the temperature read from the last stored valid heating state parameters exceeds a limit, the execution of the heating process can be terminated.

These and other aspects of the invention will be apparent from the following description and the appended claims.

BRIEF DESCRIPTION OF THE SEVERAL VIEWS OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
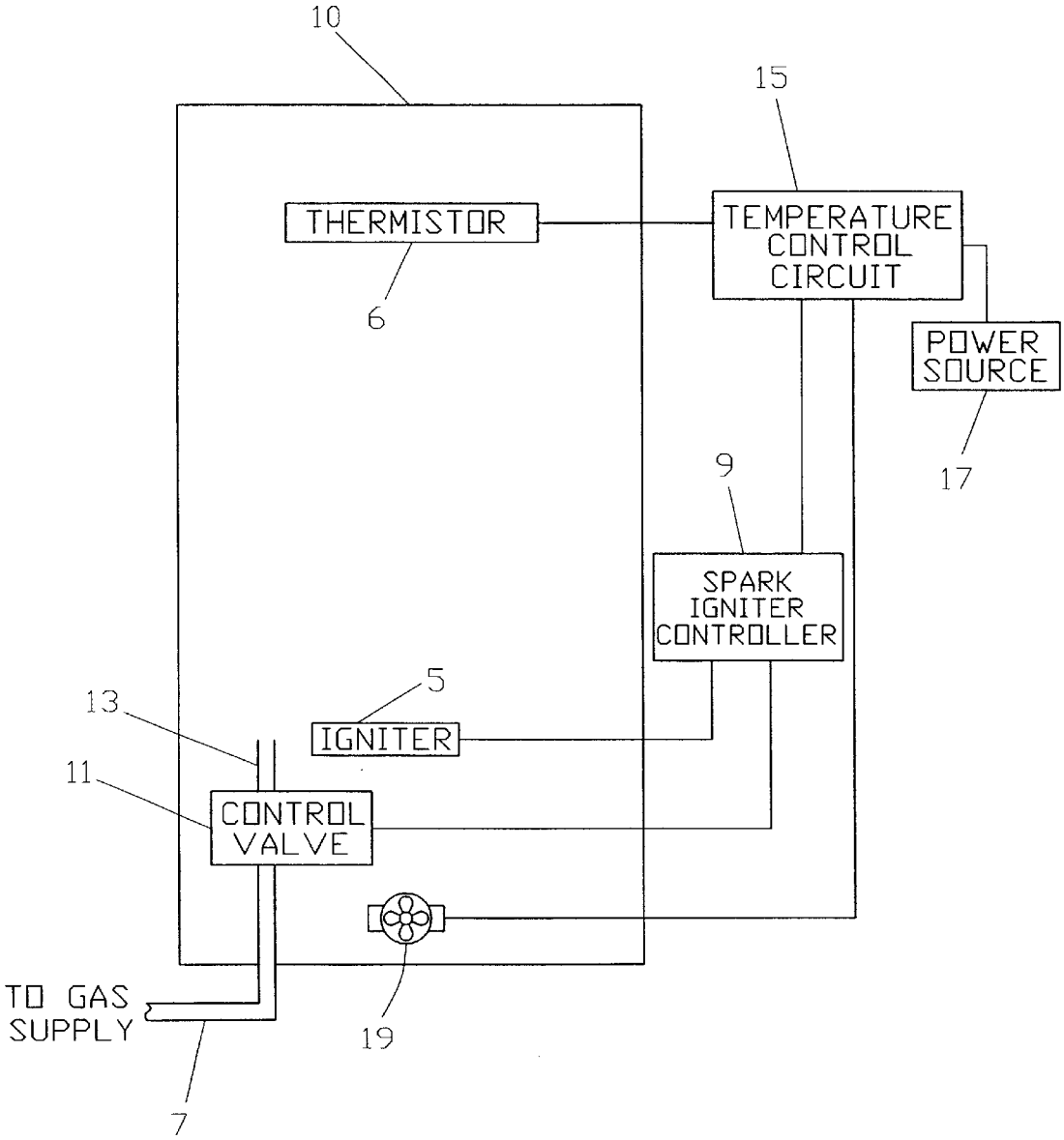
FIG. 1 PRIOR ART
FIG. 1 is a block diagram of a typical heating chamber that utilizes a thermistor temperature sensor and an electric spark igniter.
Figure 2:
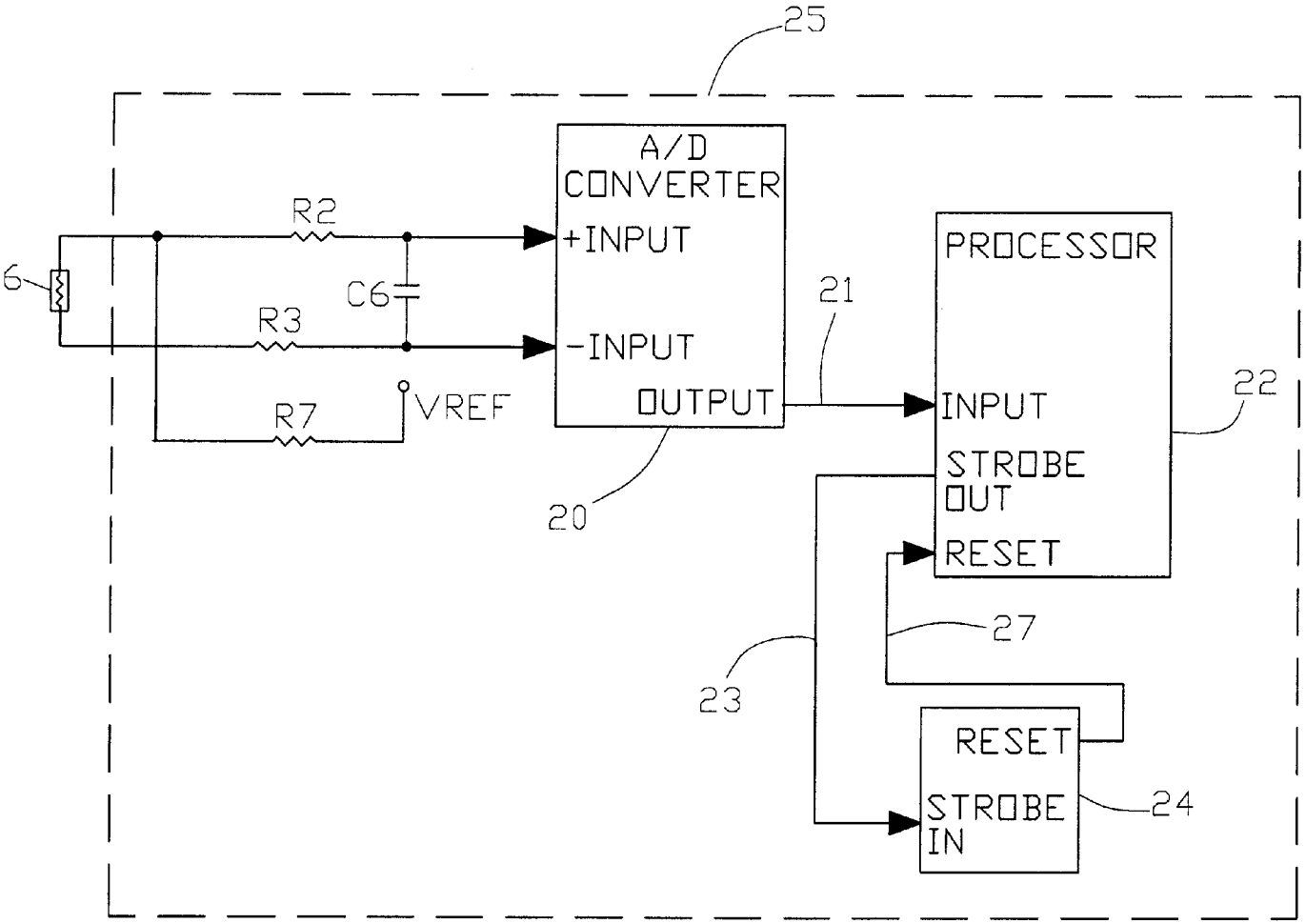
FIG. 2 PRIOR ART
FIG. 2 is a circuit diagram of a prior art temperature control circuit for a gas-fired heating chamber that utilizes a thermistor temperature sensor and an electric spark igniter.
Figure 3:
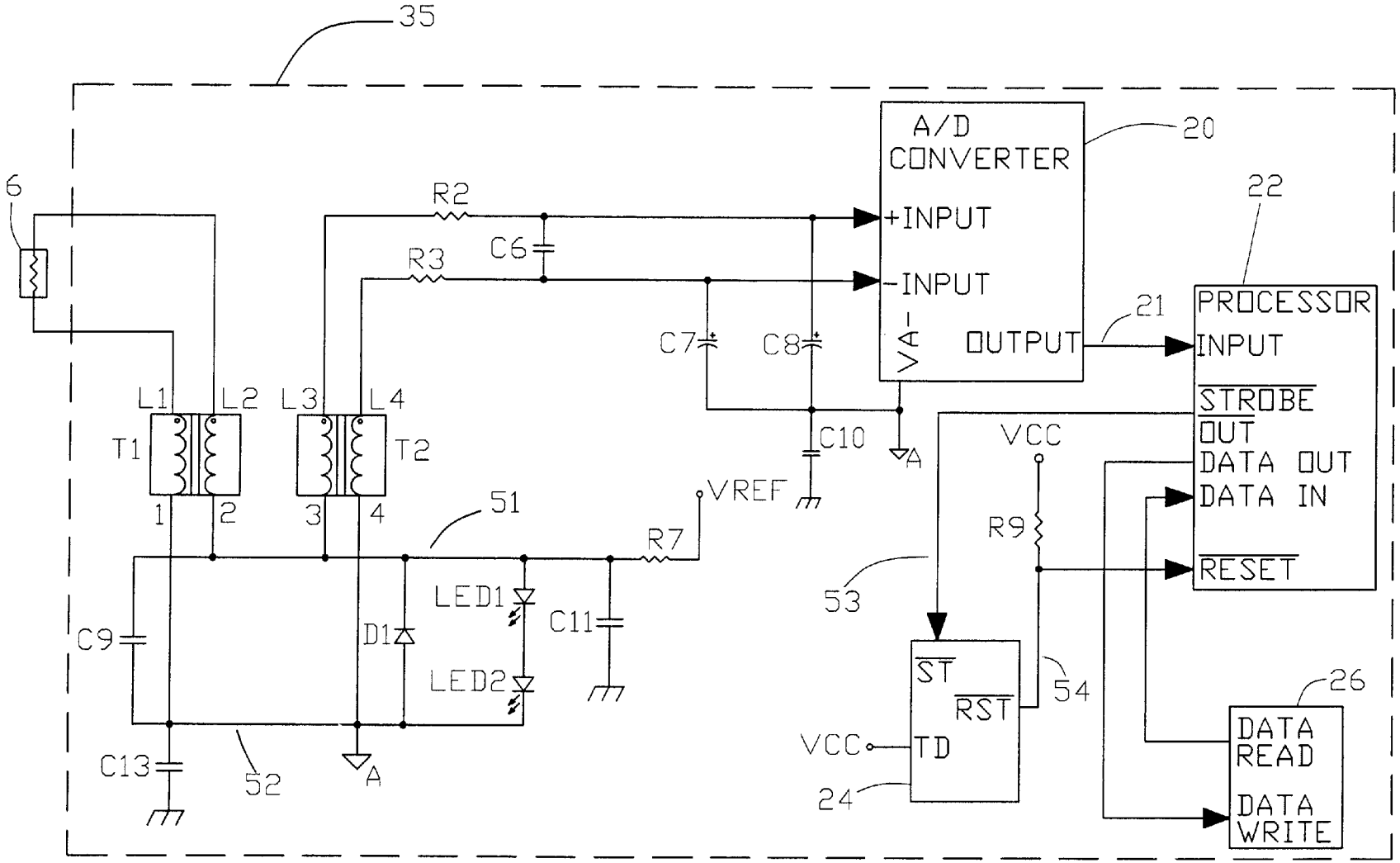
FIG. 3 is a circuit diagram of the temperature control circuit of the present invention.

There is shown in FIG. 3 one example of a temperature control circuit 35 of the present invention. The two leads of thermistor 6 are connected to line terminals L1 and L2 of first common-mode choke T1. The analog input lines to A/D converter 20 are connected to line terminals L3 and L4 of second common-mode choke T2 via R2, R3 and C6, which form an R-C circuit as previously described. In alternative embodiments, this R-C circuit, which is used for conditioning the input signal to converter 20, may be omitted or modified. Chokes T1 and T2 serve as common mode filters. A suitable component for this application is TDK Corp. of America's Part No. ZJY51R5-4P, which consists of two chokes in a single semiconductor package. First output terminals 1 and 4 of chokes T1 and T2, respectively, are commonly connected at negative polarity line 52. Second output terminals 2 and 3 of chokes T1 and T2, respectively, are commonly connected at positive polarity line 51, which is also connected to VREF through resistor R7. As described above, thermistor 6 and resistor R7 form a voltage divider network that provides a maximum analog input voltage equal to VREF to the A/D converter. In this particular embodiment, VREF is selected as 2.5 volts. A suitable converter 20 is Circus Logic, Inc.'s part No. CS5529-AP.

Light emitting diodes (LEDs) LED1 and LED2 are connected in series across lines 51 and 52 with anodes oriented to line 51. Each LED has a forward junction voltage of approximately 1.6 volts. Therefore, in this particular embodiment, with a VREF of 2.5 volts, two LEDs are used in series to produce a voltage clamp of approximately 3 volts (1.6V+1.6V). This is above the normal circuit maximum of VREF (2.5 volts), but below the maximum input voltage of 5.5 volts for the converter 20 selected for this particular embodiment. Thus if the thermistor 6 is subjected to EMI, the maximum voltage transmitted to the analog input of converter 20 will be limited to approximately the total series forward junction voltage of the LEDs. For a particular application, the number of LEDs connected in series will depend upon the forward junction voltage of each LED, the normal circuit maximum voltage and the maximum allowable input voltage for the circuit component to be protected from EMI. A suitable LED for this application is Kingbright Corp.'s Part No. L-9341D. Although this is a red LED, other LEDs, such as green and yellow LEDs are satisfactory for this application. Red LEDs are used since they have the greatest forward current capacity. Unlike diodes and zener diodes used in typical voltage clamping circuits, the LEDs exhibit essentially undetectable leakage current when they are biased below forward conduction. Reverse biased leakage of the two LEDs in series was measured at less than 0.15 $\mu$A, whereas typical currents for low leakage zener diodes are on the order of 10 times greater.

While the input sensor in the present embodiment is a temperature sensor and the protected circuit component is the analog input to an analog-to-digital converter, the LED voltage clamping circuit described above may be used with other sensors to protect EMI sensitive circuit components.

Diode D1 clamps negative polarity noise signals. A reverse biased conventional diode has sufficiently low leakage characteristics if used well below its breakdown voltage level. A suitable diode for this embodiment is Motorola Inc.'s Part No. 1N4148. Alternatively, an anti-parallel (relative to LED1 and LED2) LED can replace diode D1.

Capacitor C9 provides filtering between lines 51 and 52. Capacitor C13 provides filtering between line 52 and analog ground, and capacitor C11 provides filtering between line 51 and analog ground.

Additional filtering is provided between each input line of converter 20 and the analog-grounded low-side power supply terminal VA- of the converter by C7 and C8. C10 provides additional filtering between analog and chassis ground.

Other selections for circuit components in the disclosed embodiment are listed in the following table.

| Component | Value | Source |
|---|---|---|
| Thermistor | 0 to 100 kohms | Stratford Controls 140-50038-002 |
| R2 and R3 | 10 kohms | KOA Speer CF 1/4W 103J |
| R7 | 3.32 kohms | KOA Speer MFD332FT52 |
| C6, C9, C10, C13 and C11 | 0.1 $\mu$F | AVX SA105E104MA4 |
| C7 and C8 | 10 $\mu$F | Stantel TP106M016LP |

The temperature control circuit shown in FIG. 3 uses a nonvolatile solid state memory storage device 26 that in the preferred embodiment has a minimum performance of one billion write cycles. A suitable storage device is Ramtron International Corp.'s Part Number FM25040, which is a 4-kbit ferroelectric nonvolatile RAM. More than one storage device may be banked together to form a desired memory capacity. Alternatively, the nonvolatile memory may also be incorporated in another device, such as the processor. The minimum performance rating of the nonvolatile storage device is selected so that device 26 will be capable of performing the minimum number of incremental writes of cooking parameters over the anticipated lifetime of a heating apparatus incorporating the features of the disclosed temperature controller.

Processor monitor 24 functions as a watchdog timer to reset processor 22 if the monitor does not receive a periodic signal from the processor. A suitable processor monitor is Sipex Corp.'s Part No. 1232CPA and a suitable processor is Motorola Inc.'s MC68HC705P6A. The monitor receives via line 53 a periodic low strobe input at pin $\overline{\text{ST}}$ from a suitable output pin $\overline{\text{STROBE OUT}}$ on the processor. For the 1232CPA, with the time delay set pin TD tied to the power supply input voltage VCC, the selected time-out period for receipt of a low strobe input from the processor is 1.2 seconds. If line 53 goes high for longer than 1.2 seconds, the monitor 24 will issue a reset command to the processor via line 54. In the configuration shown in FIG. 3, a low output from pin $\overline{\text{RST}}$ will be sent to the processor for reset. VCC, through dropping resistor R9 (4.7 kohms), normally holds pin $\overline{\text{RESET}}$ on the processor high.

Figure 4:
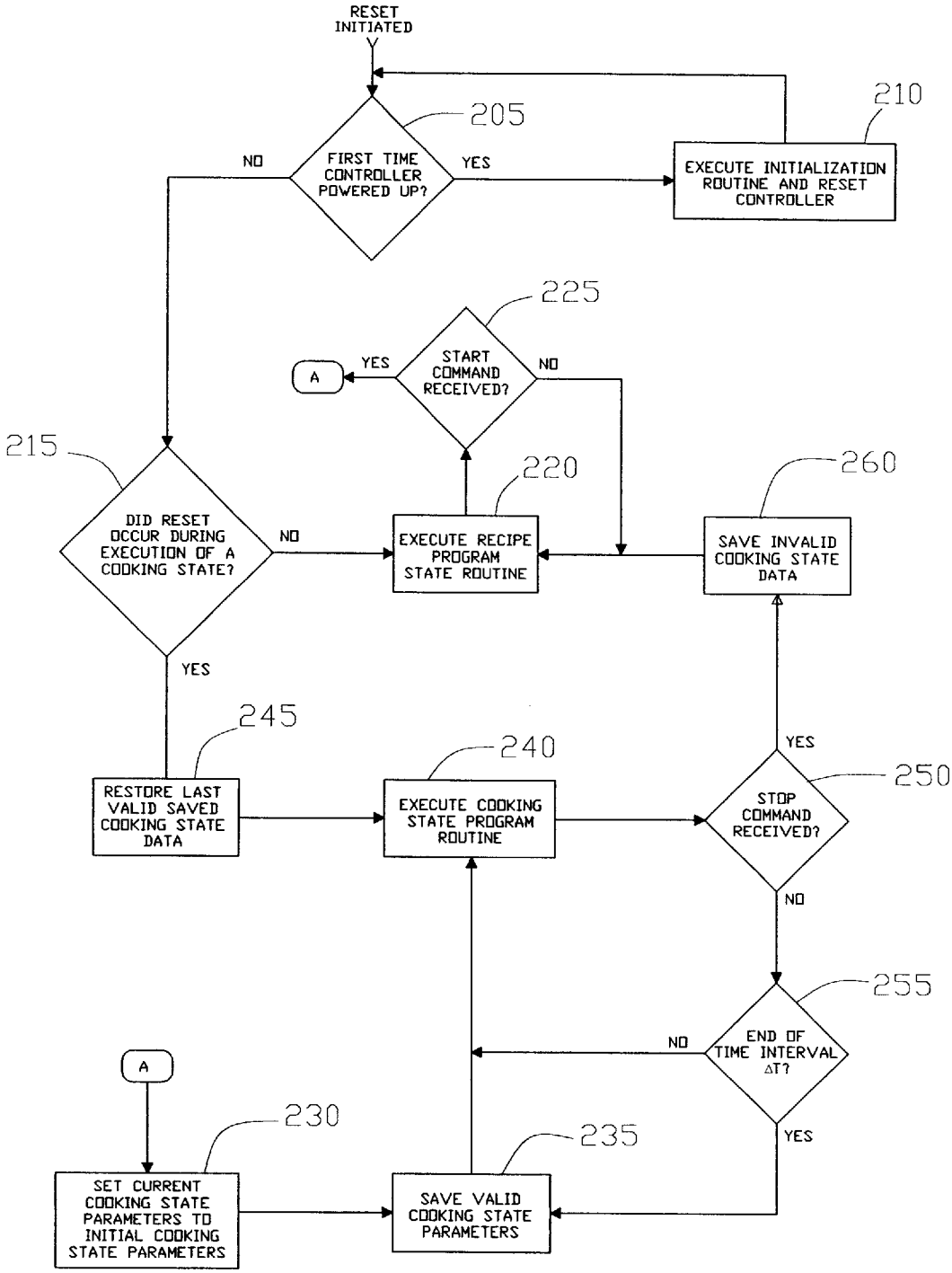
FIG. 4 is a flow chart diagram illustrating a method of storing time incremental heating parameters during execution of a cooking process prior to an unintentional processor reset and recovering the heating parameters after the reset to continue execution of the cooking process.

FIG. 4 is a flow diagram illustrating a process of storing cooking parameters at incremental time periods and recovering the last stored valid parameters after processor 22 receives an unintentional reset command. Prior to executing a cooking process, the user enters input data for the desired cooking mode or state from a suitable input device (not shown), such as a keyboard, into processor 22. As a cooking program is executed by processor 22 in the cooking state, the processor writes current cooking state parameters to device 26 at incrementally selected time periods as further described below. Cooking state parameters can include remaining cooking time, elapsed holding time, oven temperature, remaining fan pulse time and any other parameters necessary for a controlled heating of the product. The incremental parameters are written in sequential memory blocks in device 26. Stored in each memory block is a unique block number that sequentially identifies memory blocks in the order in which they are stored. The last stored block has the highest block number.

Upon initiation of a reset, the cooking program starts execution at the beginning of the program. Relative to the recovery of the last stored cooking parameters and continuation of a cooking state that may have been executing at the time of reset, routine 205 in FIG. 4 makes an initial determination as to whether the reset was due to a first startup of the controller. If this is the first startup, the program executes initialization routine 210 and restarts the cooking program.

If the reset occurs after first startup, program routine 215 initially determines the last stored block by identifying the memory block with the highest block number. Routine 215 then determines whether a VALID flag is set in the last stored data block. If the user has inputted a STOP cooking state execution command, a data block is stored in device 26 with the VALID flag not set. Therefore, if the VALID flag data is not set, the cooking program enters the recipe programming state routine 220 in which the processor waits for the user to enter a START cooking state execution command 225. After the user inputs initial cooking state parameters and the START command is entered, the current cooking state parameters are stored by routine 230. The current cooking state parameters are saved as valid cooking state parameters 235 and the cooking state program routine 240 executes.

If routine 215 determines that the VALID flag is set in the last stored data block before reset occurred, the data block represents the last stored incremental cooking state parameters before reset. Processor 22 executes routine 245 in which it reads the last stored cooking state data and continues execution of cooking state program routine 240. Optionally, prior to continued execution of cooking state program routine 240, the processor can evaluate whether the present temperature of the heating chamber 10 as sensed by thermistor 6 has dropped below a pre-determined value. If the temperature of the heating chamber has dropped to a sufficiently low temperature when the attempt is made to continue execution of, the cooking state program, for example, 50° F., when the heating chamber was at 400° F. prior to reset, a significant period of time has elapsed between the reset command and the attempt to continue execution of the cooking state programming routine. This would occur, for example, when a lengthy power interruption was encountered. Under these conditions, continuation of the cooking state process may not be preferred.

The executing cooking state routing 240 will periodically check to see if the user has inputted a STOP cooking state program routine execution command 250. If a STOP command has been inputted, a data block with the VALID flag not set will be written to device 26 by routine 260 and the cooking program will enter the recipe program state routine 220. The executing cooking state routine 240 will also periodically check to see if a predetermined time period $\Delta t$ has elapsed in routine 255. If the predetermined period has elapsed the current cooking state parameters are written in a data block to device 26 by routine 235, and then execution of the cooking state program routine 240 continues. The predetermined time period can be selected based upon selected cooking parameters, such as total cooking time. In general, a $\Delta t$ of 30 seconds provides a more than sufficient incremental interval.

Program code in an applicable programming language for the above routines can be generated by one skilled in the art to accomplish the cooking process.

The foregoing embodiments do not limit the scope of the disclosed invention. The scope of the disclosed invention is covered in the appended claims.

What is claimed is:

1. A temperature control circuit for use with a heating chamber having a temperature sensor, comprising:

a first common mode choke having a pair of line terminals and a pair of output terminals, the temperature sensor connected across the pair of line terminals of the first common mode choke;

an analog-to-digital converter having a pair of analog inputs and one or more digital outputs;

a second common mode choke having a pair of line terminals and a pair of output terminals, the pair of analog inputs being connected across the line terminals of the second common mode choke;

a positive polarity line commonly connecting a first terminal of the pair of output terminals for each one of the first and second common mode chokes;

a negative polarity line commonly connecting a second terminal of the pair of output terminals for each one of the first and second common mode chokes;

a reference voltage provider suitably connected to the positive polarity line;

a diode connected across the positive and negative lines, the anode of the diode oriented towards the negative polarity line; and one or more light emitting diodes connected in series across the positive and negative polarity lines, the anodes of the one or more light emitting diodes being oriented towards the positive polarity line, and the series forward junction voltage across the sum of the one or more light emitting diodes being greater than the reference voltage and less than a maximum voltage for the pair of analog inputs for the analog-to-digital converter.

2. The temperature control circuit of claim 1 wherein said diode is an anti-parallel light emitting diode.

3. The temperature control circuit of claim 1 wherein the temperature sensor is a thermistor.

4. The temperature control circuit of claim 3 wherein the thermistor has a resistance range of approximately zero to 100 kohms.

5. The temperature control circuit of claim 1 wherein an R-C circuit is provided between the pair of line terminals of the second common mode choke and the pair of analog inputs.

6. The temperature Control circuit of claim 1 further comprising capacitive filtering between the positive polarity line and a ground point, and capacitive filtering between the negative polarity line and the ground point.

7. The temperature control circuit of claim 6 further comprising capacitive filtering between the pair of analog inputs of the analog-to-digital converter and the ground point.

8. A method of reducing the electromagnetic susceptibility of a circuit component having an input sensor susceptible to radiated electromagnetic interference, the method comprising the following steps:

connecting the input sensor across a line input of a first common mode choke, the first common mode choke having a positive and a negative polarity outputs;

connecting a reference voltage to the positive polarity output of the first common mode choke;

connecting a diode across the positive and negative polarity outputs of the first common mode choke, the diode having its anode oriented to the negative polarity output of the first common mode choke;

connecting one or more light emitting diodes in series across the positive and negative polarity outputs of the first common mode choke with the anodes of each one of the one or more light emitting diodes oriented to the positive polarity outputs, the one or more light emitting diodes having a total series forward junction voltage greater than the reference voltage and less than a maximum input voltage for the circuit component;

connecting a positive and a negative polarity outputs of a second common mode choke to the positive and negative polarity outputs, respectively, of the first common mode choke; and connecting the circuit component to a line input of the second common mode choke, whereby the circuit is subjected to a maximum voltage approximately equal to the total series forward junction voltage of the one or more light emitting diodes.

9. The method of claim 8 wherein the input sensor is a thermistor.

10. The method of claim 8 wherein the circuit component is an analog-to-digital converter.

11. The method of claim 8 wherein said diode is an anti-parallel light emitting diode.

12. The method of claim 9 further comprising providing capacitive filtering across the positive and negative polarity outputs of the first common mode choke and a ground point.

13. A method of recovering from a processor reset during the execution of a heating process used with a temperature controller for a heating chamber, the method comprising the following steps:

during execution of the heating process, incrementally storing at a fixed time interval one or more valid heating state parameters in a nonvolatile memory device; and after interruption of the heating process with a processor reset:

reading a last incrementally stored one or more valid heating state parameters from the nonvolatile memory device, the last incrementally stored one or more valid heating state parameters having been stored at the last fixed time interval prior to interrupting the heating process; and resuming execution of the heating process at a point determined from the last incrementally stored one or more valid heating state parameters.

14. The method of recovering from a processor reset of claim 13, wherein a temperature of the heating chamber is one of the one or more valid heating state parameters, comprising the further steps of:

prior to resuming execution of the heating process, sensing a current temperature of the heating chamber;

comparing the current temperature of the heating chamber with a temperature of the heating chamber from the last incrementally stored one or more valid heating state parameters; and terminating execution of the heating process if the difference between the current temperature and the temperature of the heating chamber from the last incrementally stored one or more valid heating state parameters exceeds a limit.

* * * * *